United States Patent [19]

Allen et al.

[11] 4,421,140

[45] Dec. 20, 1983

[54] DOBBY-ACTIVATED LOOM MOTION LOCK-OUT DEVICE

[75] Inventors: Danny H. Allen; John H. Sumner, both of Greensboro, N.C.

[73] Assignee: Burlington Industries, Inc., Greensboro, N.C.

[21] Appl. No.: 331,833

[22] Filed: Dec. 17, 1981

[51] Int. Cl.[3] ..... D03D 51/04

[52] U.S. Cl. ..... 139/1 E

[58] Field of Search ..... 139/1 R, 1 E, 336; 66/1 R, 157

[56] References Cited

U.S. PATENT DOCUMENTS 3,318,341 5/1967 Nollet ..... 139/1 E
3,435,854 4/1969 Svaty et al. ..... 139/1 E
3,633,197 1/1972 Dunlap ..... 139/336
3,805,850 4/1974 Doynhoven et al. ..... 139/1 E

*Primary Examiner*—Henry Jaudon
*Attorney, Agent, or Firm*—Cushman, Darby & Cushman

[57] ABSTRACT

A weaving machine that is used in conjunction with a lever-controlled dobby head, e.g. a Ruti L-5000 with a Staubli dobby head, is provided with an apparatus-coordinating control system for eliminating fabric defects caused by the following operator errors:

a. Running loom with dobby lever in reverse,
b. Forward jogging loom with dobby lever in reverse,
c. Reverse jogging loom with dobby lever in run,
d. Leaving dobby lever in any position other than the run and reverse positions.

3 Claims, 4 Drawing Figures

Fig. 1 ORIGINAL WIRING
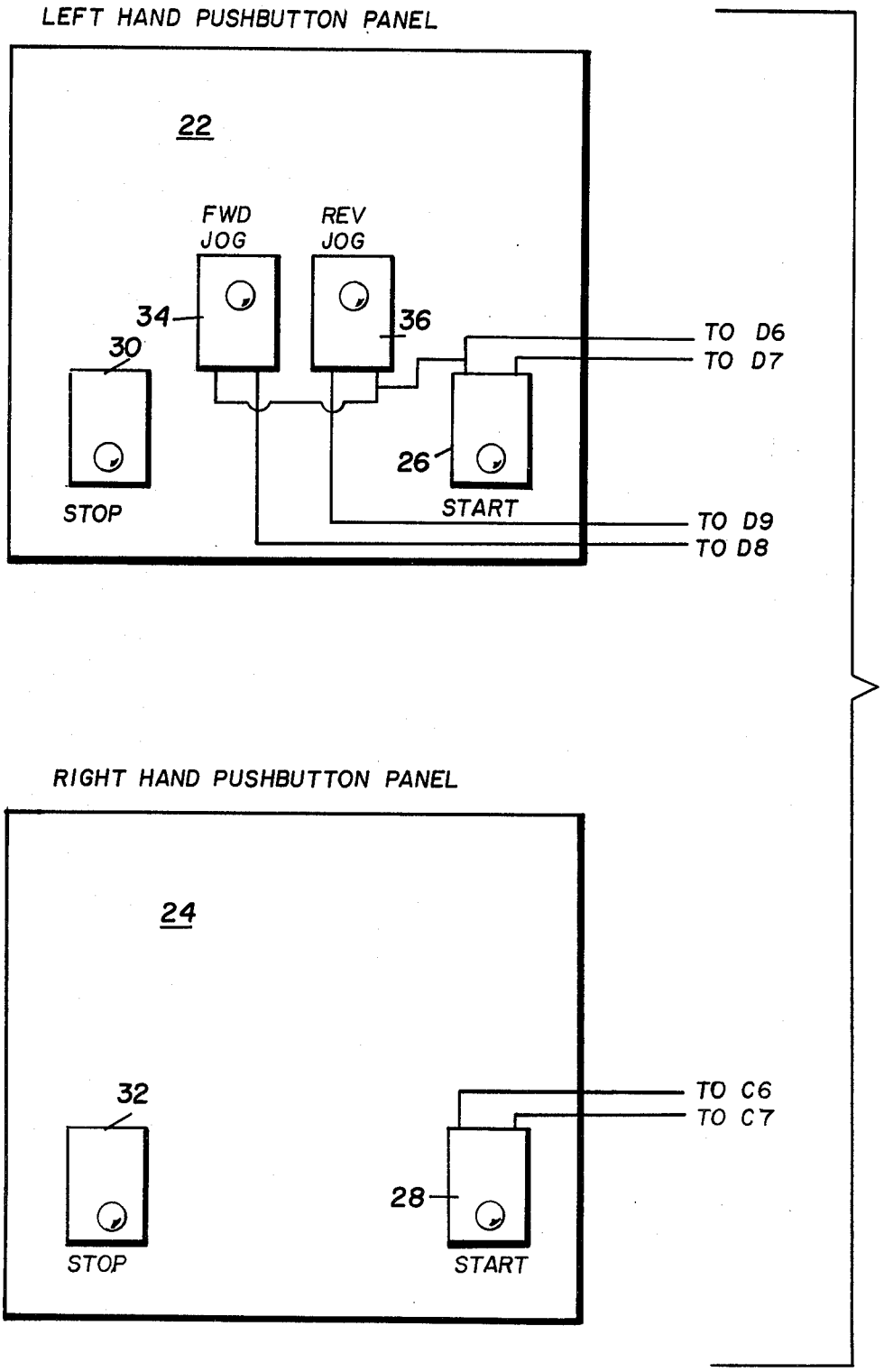

Fig. 2 MODIFIED WIRING
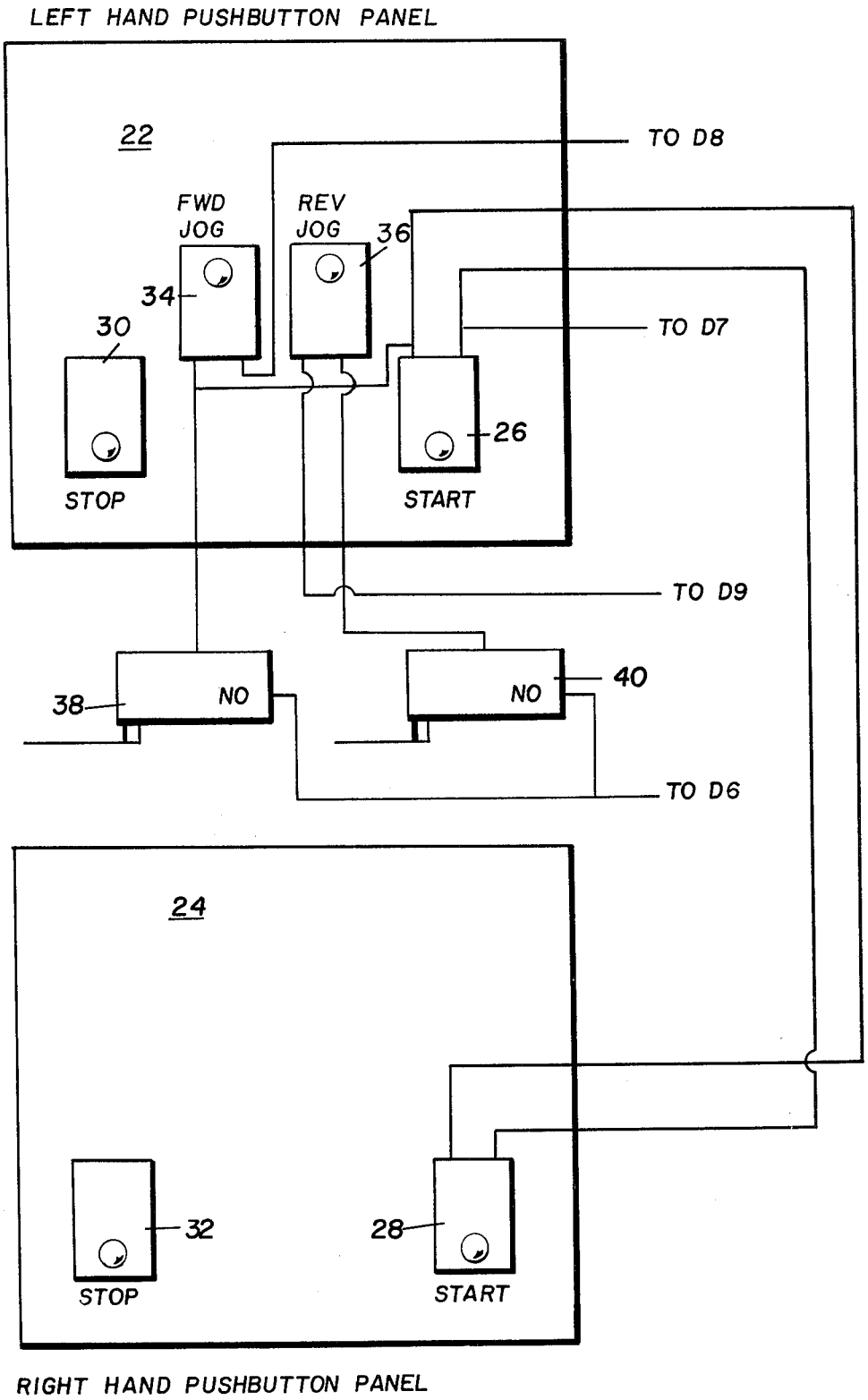

DOBBY-ACTIVATED LOOM MOTION LOCK-OUT DEVICE

BACKGROUND OF THE INVENTION

When a Ruti L-5000 weaving machine is used in conjunction with a Staubli dobby head, a pattern defect can be caused by improper operator technique. The Staubli head is a device used to control the weaving pattern of the cloth by means of a rotating pattern chain. It has a control lever that can be placed in several positions. The positions used most frequently during normal operation are RUN and REVERSE. Other positions exist but are used less frequently and deal mainly with loom set-up. The RUN position is used for normal operation.

The REVERSE position is normally used when correcting a loom-stopping defect, i.e., in trade terms, "matching the pick". During this correctional procedure the operator can create an additional pattern defect unless the proper technique is used.

While the Staubli pattern chain movement is controlled by the lever, loom movement (rotation) is controlled by a separate means. Button-activated switches allow the loom to be started, stopped, forward jogged or reverse jogged. Proper technique requires that the direction of loom movement be correlated with the setting of the Staubli lever. Quite simply, this means that if the operator pushes the wrong movement button while the Staubli is in a particular setting, a pattern defect can be caused that will be seen when the loom is started. This has previously been prevented to a degree through operator training. However, errors still occur, creating fabric defects.

SUMMARY OF THE INVENTION

The present invention greatly reduces the probability of making errors during correction of loom-stopping defects. It insures that the loom can only be moved in the respectively proper direction when the Staubli lever is in each of its settings.

Accordingly, it is an object of the invention to eliminate fabric defects caused by the following operator errors.

a. Running loom with dobby lever in reverse.
b. Forward jogging loom with dobby lever in reverse.
c. Reverse jogging loom with dobby lever in run.
d. Leaving dobby lever in any position other than the run and reverse positions.

It is a further object of the invention to permit a reduction in the time devoted to training an operator to run a Ruti L-5000 weaving machine used in conjunction with a Staubli dobby head, by simplifying the start-up of the apparatus itself.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWING

In the Drawings:

FIG. 1 is a schematic representation of the operator's control panels for a weaving machine used in conjunction with a lever-controlled dobby head according to the PRIOR ART;

FIG. 2 is a schematic representation of the same control panels as improved by use of the principles of the present invention;

DETAILED DESCRIPTION

Prior Art

Figure 3:
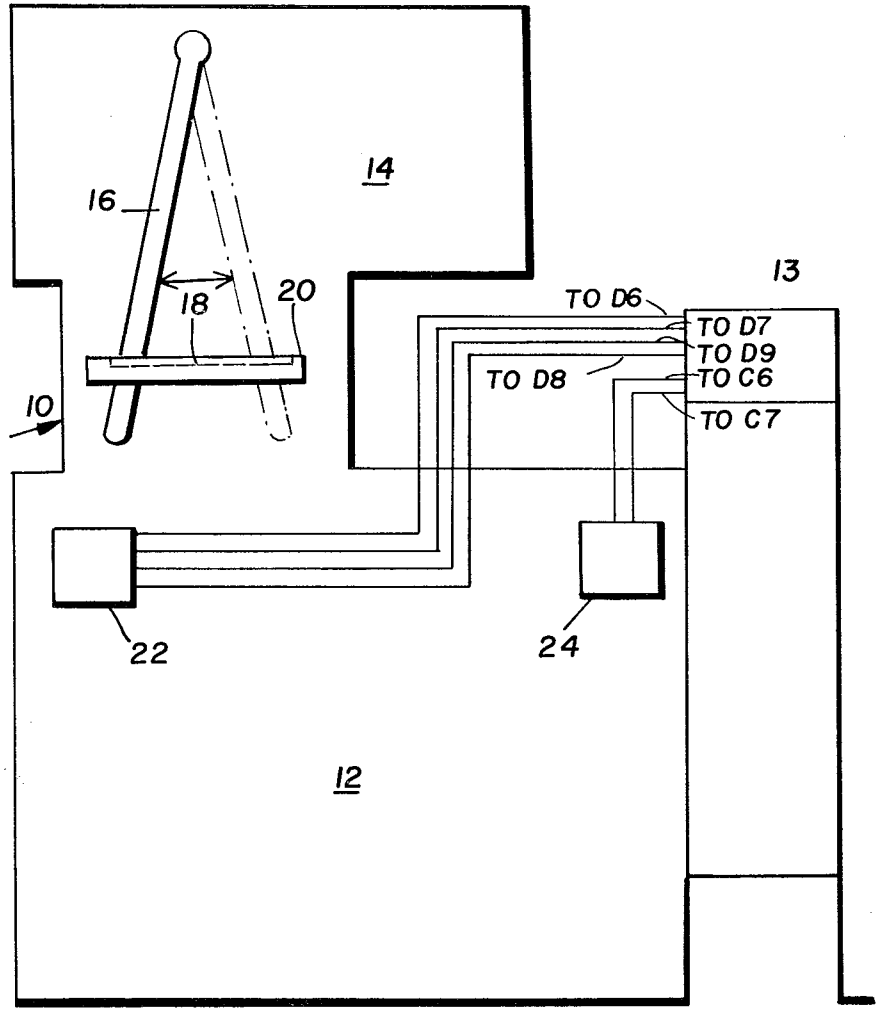
FIG. 3 is a schematic representation of the front of the weaving machine and operatively associated dobby head according to the PRIOR ART.

With reference to FIGS. 1 and 3, a conventional, PRIOR ART operator's control station 10 is shown for a weaving machine or loom 12, e.g. a Ruti L-5000 weaving machine used in conjunction with a lever-controlled dobby head 14 such as a Staubli dobby head.

At the FIG. 3 PRIOR ART control station, the dobby head control is shown being constituted by a lever 16 which projects downward within a guide slot 18 (shown in phantom lines) in a bracket 20. The lever 16, when shifted along the slot in the position shown in full lines, places the dobby in its RUN condition of operation and when shifted along the slot to the position shown in phantom lines, places the dobby in its REVERSE condition of operation. The actual shifting is manually accomplished by the operator by moving the lever from its full line position to its phantom line position and vice versa. It is possible for the operator to leave the lever at a position that is intermediate the two which are illustrated, in which case the dobby may be in either RUN or REVERSE, depending on how far the lever is moved.

Also at the FIGS. 1 and 3 PRIOR ART control station, the loom control is shown being constituted by a left-hand push button panel 22 and a right-hand push button panel 24. These buttons are connected to the loom electrical control box 13. As shown, there are three ways that the operator can cause the loom to operate in a forward direction:

(a) push the START button 26 on the left-hand control panel, or
(b) push the START button 28 on the right-hand control panel (in either of which cases the loom will initiate operation and continue to operate until stopped by the operator by pressing the STOP button 30 on the left-hand control panel or the STOP button 32 on the right-hand control panel), or
(c) push the FORWARD JOG button 34 on the left-hand control panel, whereupon the loom will operate in a forward direction until the operator releases the FORWARD JOG button 34. There is also a way for the operator to operate the loom in a reverse direction: push the REVERSE JOG button 36, whereupon the loom will operate in a reverse direction until the operator releases the REVERSE JOG button 36.

The wiring of the push button switches in circuit with one another and with the loom in the PRIOR ART control system typically is laid out as is schematically illustrated in FIGS. 1 and 3.

In the PRIOR ART control station 10 shown in FIGS. 1 and 3, there is no mechanical, electrical, pneumatic, hydraulic or other inanimate coordinating connection between the dobby head control lever 16 and the push button control system 13/22/24, but only the human operator. Accordingly, the human operator may make the following operating errors:

a. Running loom with dobby lever in reverse,
b. Forward jogging loom with dobby lever in reverse,
c. Reverse jogging loom with dobby lever in run,
d. Leaving dobby lever in any position other than the run and reverse positions.

Nothing in the PRIOR ART control system will either prevent those errors being committed or fabric defects being thereby caused.

THE INVENTION

The present invention involves both some rewiring of the existing switches and the incorporation of two further, normally-open microswitches or the like into the push button control system 13/22/24, with their actuators so arranged as to be held closed by particular positioning of the dobby head control lever 16.

Figure 4:
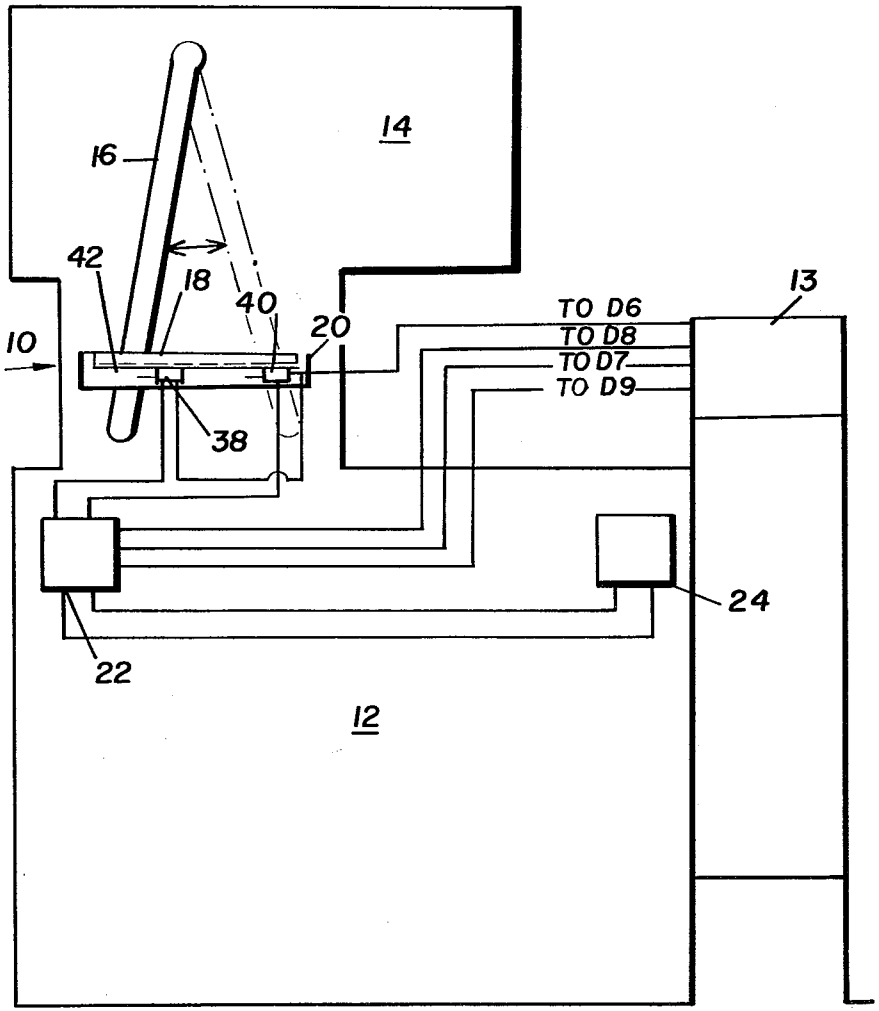
FIG. 4 is a schematic representation of the front of the weaving machine and operatively associated dobby head as improved by the use of the principles of the present invention.

In particular, with reference to FIGS. 2 and 4, two normally-open microswitches or the like 38, 40 are mounted in the vicinity of the dobby head control lever 16, for instance by being mounted on a plate 42 which is in turn mounted on the bracket 20 near the slot 18. The push button switches are rewired as typically illustrated in FIG. 2, and are connected to the electrical control box 13.

Accordingly, when the dobby head control lever is in the RUN position shown in full lines, it depresses the actuator of the microswitch 38, closing that switch and permitting completion of the circuit in which it is incorporated. This permits the loom to be operated in a forward direction by pushing either the START button 26, the START button 28 or the FORWARD JOG button 34, with all of which the microswitch 38 is wired in series. Reverse operation, i.e., reverse jogging of the loom, is impossible, because the microswitch 40 remains open, thus keeping open the circuit in which the REVERSE JOG button 36 is incorporated; if the REVERSE JOG button 36 is pushed, nothing happens.

In the alternative, when the dobby head control lever 16 is moved to the REVERSE position shown in dashed lines, it depresses the actuator of the microswitch 40, closing that switch and permitting completion of the circuit in which it is incorporated. This permits the loom to be operated in a reverse direction by pushing the REVERSE JOG button 36, with which the microswitch 40 is wired in series. Forward operation of the loom is impossible, because the microswitch 38 remains open, thus keeping open the circuit(s) in which the START button 26, the START button 28 and the FORWARD JOG button 34 are incorporated; if either of the START buttons or the FORWARD JOG button is pushed, no loom movement occurs.

In the further alternative, if the operator has positioned the dobby head control lever 16 between the two extremes, neither microswitch 38 nor microswitch 40 is closed, and no loom movement occurs if any of the buttons 26 through 36 are pushed; the loom is thus prevented from being run or jogged in either direction.

It should now be apparent that the dobby-activated loom motion lock-out device as described hereinabove, possesses each of the attributes set forth in the specification under the heading "Summary of the Invention" hereinbefore. Because it can be modified to some extent without departing from the principles of the invention as they have been outlined and explained in this specification, the present invention should be understood as encompassing all such modifications as are within the spirit and scope of the following claims.

What is claimed is:

1. For a loom which is capable of being run forwards, jogged forwards, jogged in reverse, which is being used in conjunction with a lever-controlled dobby head having a control lever which is shiftably mounted relative to a guide bracket at an operator's control station, for shifting between a RUN position and a REVERSE position, which positions are spaced apart so as to permit the lever to be positioned in an intermediate position which is located between the RUN and REVERSE positions, and wherein the loom is electrically powered by means including electrical circuitry including at least one START/STOP push button switch located at said operator's control station, a FORWARD JOG push button switch located at said operator's control station and a REVERSE JOG push button switch located at said operator's control station, a control station improvement comprising:

a first microswitch means wired in series with said at least one START/STOP push button switch and with said FORWARD JOG push button switch in said circuitry, said first microswitch means being normally open and having a respective actuator which, only while actuated, keeps said first microswitch means closed;

a second microswitch means wired in series with said REVERSE JOG push button switch in said circuitry, said second microswitch means being normally open and having a respective actuator which, only while activated, keeps said second microswitch means closed;

means mounting the first microswitch means relative to said lever in such a disposition that said actuator of said first microswitch means will be maintained in an actuated condition by engagement with said lever only when said lever is in said RUN position, and mounting the second microswitch means relative to said lever in such a disposition that said actuator of said second microswitch means will be maintained in an actuated condition by engagement with said lever only when said lever is in said REVERSE position, whereby:

said loom may be run forwards or jogged forwards, but not jogged in reverse while said dobby head control lever is in said RUN position, said loom may be jogged in reverse, but neither run forwards nor jogged forwards while said dobby head control lever is in said REVERSE position, and said loom may not be run forwards, may not be jogged forwards and may not be jogged in reverse when said dobby head control lever is in said intermediate position.

2. The apparatus of claim 1, wherein:

said loom is a Ruti L-5000 weaving meachine and said dobby head is a Staubli lever-controlled dobby head.

3. The apparatus of claim 1, wherein:

said mounting means is constituted by a plate on which both said microswitch means are mounted, said plate being mounted on said guide bracket of said dobby head control lever.

* * * * *